United States Patent [19]

Shang

[11] Patent Number: 4,927,381

[45] Date of Patent: May 22, 1990

[54] ELECTRICAL PUSH-PULL CONNECTOR

[76] Inventor: Jean Y. Shang, 1, Lane 118, San Ho Rd., Fong Ywan City, Taichong County, Taiwan

[21] Appl. No.: 385,089

[22] Filed: Jul. 26, 1989

[51] Int. Cl.[5] ..... H01R 4/24

[52] U.S. Cl. ..... 439/438

[58] Field of Search ..... 438/436–441, 438/577, 620–622

[56] References Cited

U.S. PATENT DOCUMENTS 4,257,664 3/1981 Munroe ..... 439/441

*Primary Examiner*—Joseph H. McGlynn

*Attorney, Agent, or Firm*—Morton J. Rosenberg; David I. Klein

[57] ABSTRACT

An electrical push-pull connector which includes a housing (1) having a pair of slots (11 and 12) formed through a top surface thereof for insert of a pair of electrical leads (A and B). An insulation disc (2) is secured to the housing (1). A screwshell member (3) is secured to the housing (1) and the screwshell member (3) and the insulation disc (2) are rivetted to the housing (1). A displaceable actuation mechanism is provided for electrically actuating the connector system. The displaceable actuation mechanism includes a longitudinally extending and displaceable push-pull stem member (4) which extends through the housing (1). The push-pull stem member (4) has coupled to it an electrically conductive sliding brass member (42) which is displaceable within a central slot formed in a housing (1). A coil spring (43) contacts the stem member (4) for biasing the stem member (4) in a predetermined direction. A pair of bent spring members (7 and 5) are locationally positioned on opposing sides of the central slot for displaceable contact with the sliding brass member (42). An insulation member (17) is mounted on the insulation disc (2) and there is included a C-contoured spring (10) positioned within the recess of the housing (1) for contacting one of the bent spring members (5 and 7). In this manner, there is provided a combination of elements which provide for an economically constructed electrical push-pull connector.

6 Claims, 5 Drawing Sheets

ELECTRICAL PUSH-PULL CONNECTOR

BACKGROUND OF THE INVENTION

1. Field of the Invention

The improved electrical push-pull connector relates to an improvement in the constructional elements for a push-pull connector system particularly adapted to base lamp holders. In particular, a pair of openings, holes or slots are formed through a top surface of a housing for insert thereof of electrical leads. More in particular, the subject invention pertains to an electrical push-pull connector system where a pair of vent spring members are locationally positioned within the housing or body to accept and contact the electrical leads. Still further, this invention is directed to an electrical push-pull connector wherein the pair of vent spring members are inserted into the housing or body in a manner such that they are springingly biased to contact and clamp the electrical leads which are inserted within the housing or body. In order to actuate or deactuate the power, a stem member is merely reversibly displaced in a predetermined direction for contact and non-contact with electrically conducting elements for providing a power on condition or a power off condition.

2. Prior Art

In general, electrical connectors are known in the art, however, as commonly used for lamp holders, such connectors provide a soldered connection or a screw type connection for coupling electrical leads. However, the construction of such prior art push-pull type connectors include much time in construction and are inconvenient in manufacture, since such requires a plurality of controlling manufacturing tools such as soldering irons and wrench type tools including screwdrivers and associated hardware to complete the construction.

In general, the conventional methods of manufacture provide limited applicability and further provide a low quality push-pull connector.

Other prior art push through type switched lamp holders provide for soldering or threaded connections and are used to fasten and electrically couple electric wires onto a brass conductor. Such prior art connectors include various spring members arranged in the lamp holder, however, these prior art electrical connectors provide a complicated design which increases the costs of labor.

Conventional switched lamp holder connectors have been connected by screw or threaded connection and have been used for a number of decades without any substantial improvement. Prior art known to the Applicant include West German patent application Nos. 1911887; and, 2250456. Additionally, Great Britain patent application No. 2040608 and U.S. Pat. Nos. 2,576,856; 2,283,405; 3,125,392; 2,713,668; and, 4,257,664 all direct themselves to similar types of connectors but such are not adapted to mate with switches on lamp holders.

SUMMARY OF THE INVENTION

An electrical push-pull connector which includes a housing having a pair of slots formed through a top surface thereof for insert of a pair of electrical leads. An insulation disc is provided and is secured to the housing. A screwshell member is secured to the housing with the screwshell and the insulation disc being riveted to the housing. The screwshell is substantially tubular in contour and has internal threads for threaded coupling to a lamp base. A displaceable actuation mechanism is provided for electrically actuating the connector. The displaceable actuating mechanism includes a longitudinally extending and displaceable push-pull stem member which extends through the housing. Push-pull stem member has coupled thereto an electrically conductive sliding brass member which is displaceable within a central slot formed in the housing. A coil spring contacts the stem member for biasing the stem member in a predetermined direction. A pair of bent spring members are located on opposing sides of the central slot for displaceable contact with the sliding brass member. An insulating member is mounted on the insulation disc and the C-contoured spring is positioned within a recess of the housing for contacting one of the bent spring members.

An objective of the present invention concept provides for an improvement of a sectional connector for switched medium base lamp holders through use of a push-in type contact and includes guiding holes for electrical leads on top of the housing for the lamp holder. The electrical leads are pinched or clamped individually through the guiding holes or slots by bent spring members which provide a spring force to firmly grasp or pinch the electrical leads. Additionally, the push-through type stem includes in combination two pieces of spring members forming a stable construction and allows the springs and the electrical leads to be non-deformed as they are electrically coupled.

Another objective of the subject invention provides for an improvement of the action from a U-type stem and a C-type sliding brass conductor connected together through a spiral spring. Electrical conduction is performed through the contact of the C-type conductor and a pair of bent springs while the U-type push-in stem is displaced in one direction.

BRIEF DESCRIPTION OF THE DRAWINGS

FIG. 2-1 is a bottom view of the electrical push-pull connector;

FIG. 3-1 is a perspective view of a bent spring member;

FIG. 4-1 is a perspective view of a second bent spring member;

FIG. 4-2 is a perspective view of an inserted spring member;

FIG. 5-1 is a perspective view of a preventive or electrically insulating member inserted within the housing;

FIG. 5-2 is a perspective view of a U-shaped spring member; and,

DESCRIPTION OF THE PREFERRED EMBODIMENTS

Figure 1:
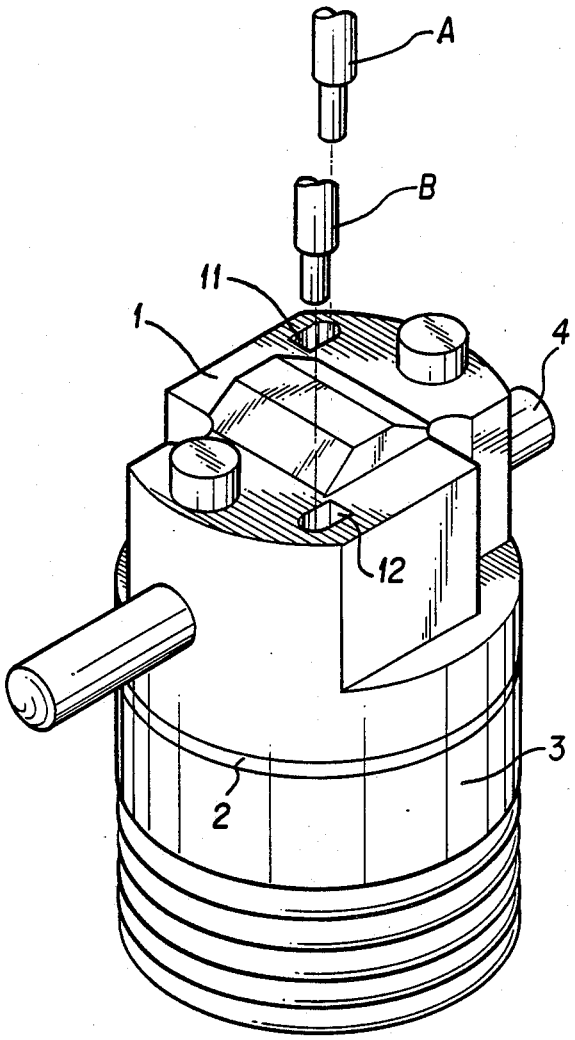
FIG. 1 is a perspective view of the electrical push-pull connector.
Figure 2:
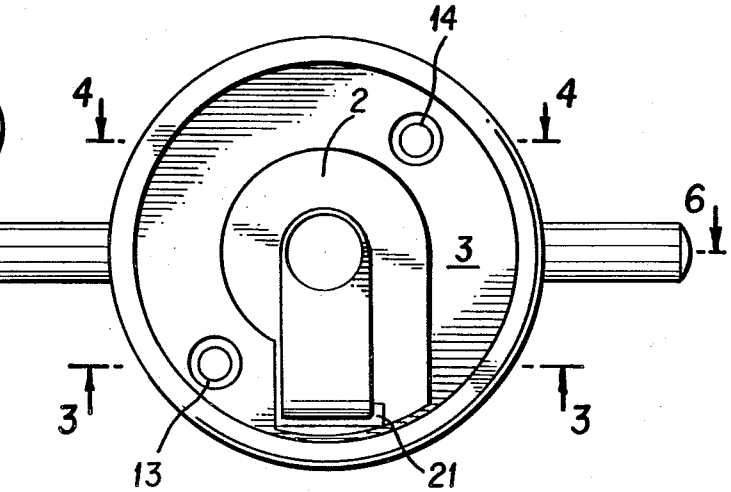
FIG. 2 is a bottom view of the electrical push-pull connector.

Referring now to FIGS. 1 and 2, there is provided an electrical push-pull connector which includes a housing or body 1 as well as an insulation disc 2 in combination with a screwshell member 3 and a push-pull stem member 4 which extends through the body or housing 1. The push-pull stem member 4 has coupled thereto an electrically conductive sliding brass member 42 displaceable within a central slot formed in the housing or body 1 to be described in following paragraphs. The body or housing 1 has a pair of slots or openings 11 and 12 which are formed through a top surface of the housing 1. Openings or holes 11 and 12 act as guiding holes to hold electrical leads A and B which are inserted therein.

On opposing sides of the openings or holes 11 and 12, there are a pair of holes formed in housing 1 for rivets 13 and 14. The rivets 13 and 14 fasten the insulation disc 2 and screwshell member 3 each to the other. Near the edge of the insulation disc 2 there is provided a slot 21 which is punched out for a conducting material such as a tongue which extends to a central portion of the housing for ultimate contact with a lighting member, such as a lamp bulb. The screw-shell 3 is riveted to insulation disc 2 and has an open area to maintain the electrically conducting tongue.

Figures 2, 3:
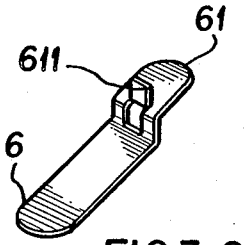
FIG. 3 is a sectional side view of the electrical push-pull connector.
Figures 1, 4:
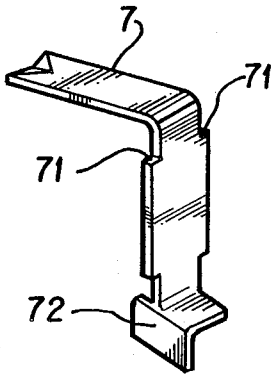
Figures 1, 3:
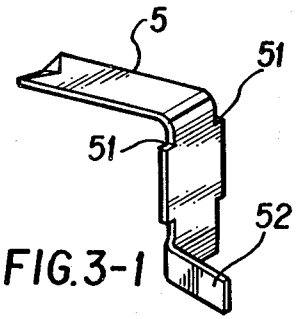
Figure 3:
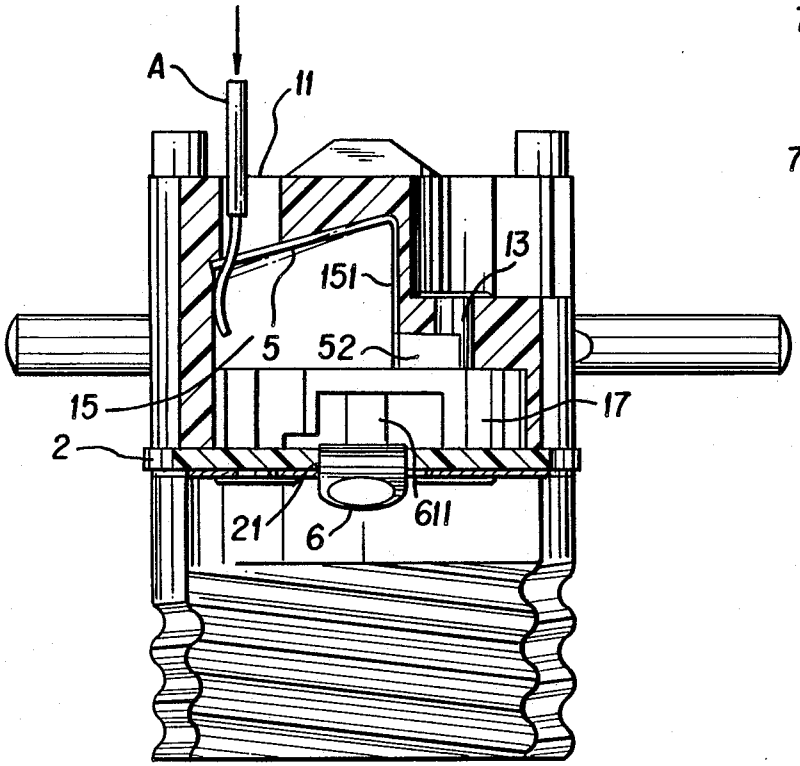
Figures 1, 2:
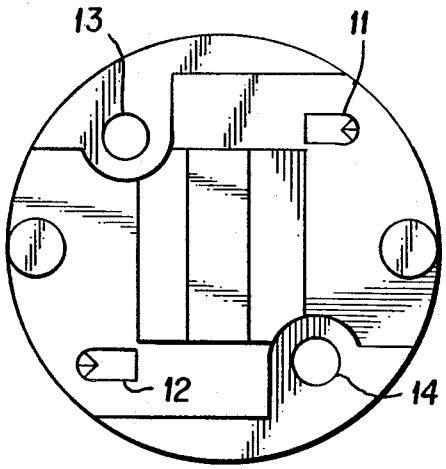
Figure 4:
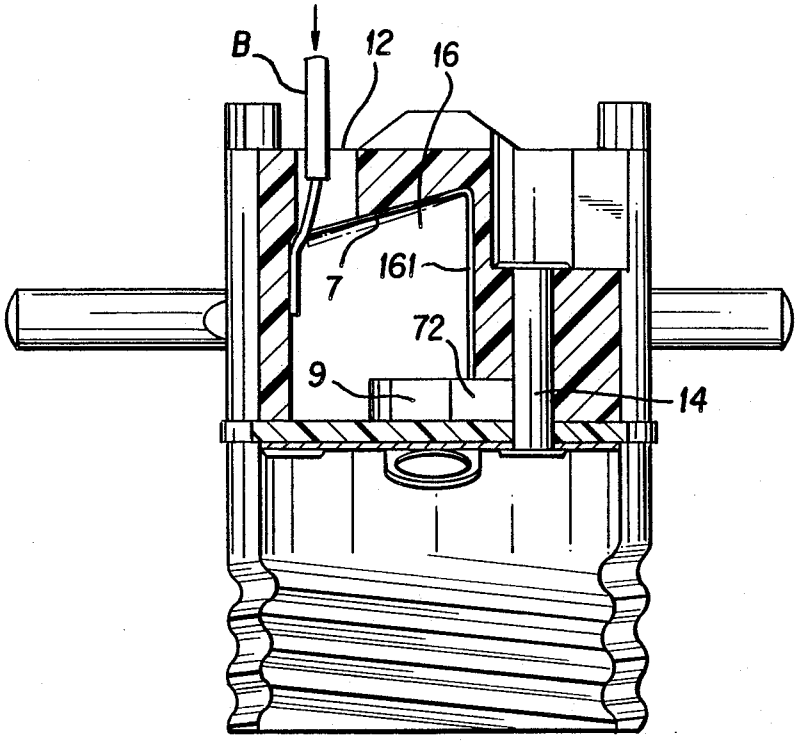

As is shown in FIG. 3, one end of the body or housing 1 has molded therein a pit 15 in which the grooves 151 are formed for insert of the shoulder 51 of bent spring member 5 as is shown in FIG. 3-1. One end of the bent spring 5 is notched and is positionally located at the bottom of the groove 11 to hold an electrical lead wire inserted within one of the guiding holes 11 and 12. In this manner, the electrical lead wire is clamped, grasped and pinched firmly by bent spring 5.

Another Z-shaped spring 6 is provided as is shown in FIG. 3-2. One bent end 61 is inserted through the slot 21 in insulation disc 2 and is tightened by pressure from rivets 13 to the housing or body 1 and the insulation disc 2. As is seen, the tip 611 of spring member 6 includes a bent end 61 which is coupled to spring 8 to provide electrical contact.

Figures 2, 4:
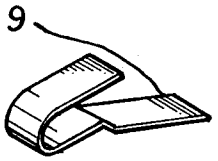
FIG. 4 is a second sectional side view of the electrical push-pull connector.

Referring now to FIG. 4, there is shown a pit 16 on an opposing side of the body or housing 1. Within the pit 16 is formed a pair of grooves 161 for the insert of shoulder 71 of spring member 7, as is shown in FIG. 4-1. The top of spring member 7 is notched in order to contact an electrical lead wire. The spring 7 is located at the bottom of hole 12. An electrical lead wire is clamped, grasped and pinched by bent spring 7 and by the corresponding arched wall formed by the appropriate opening insert. An opposing end of bent spring 7 is connected with the spring 9, as is shown in FIG. 4-2 to conduct electricity.

Figures 2, 5:
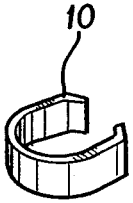
FIG. 5 is a sectional top view of the electrical push-pull connector showing the actuation mechanism for the push-pull stem member.
Figures 1, 5:
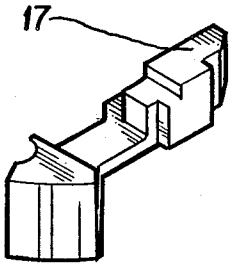
Figure 5:
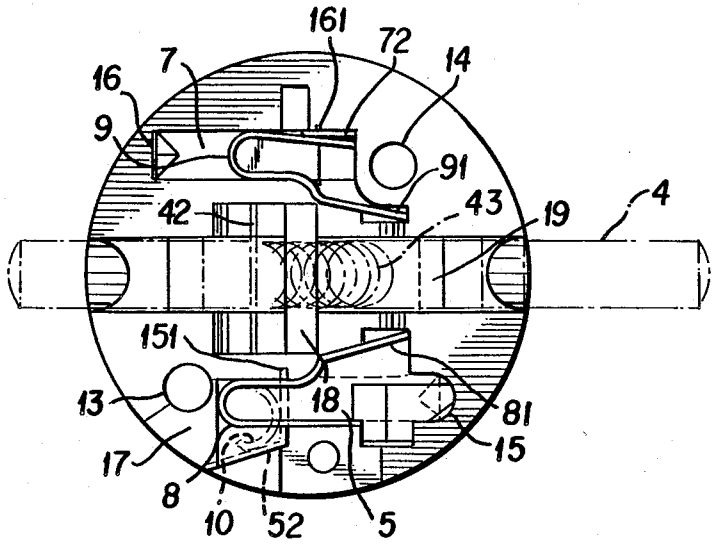

As shown in FIG. 5, an insulation member or preventive 17 is inserted within pit 15 between bent spring 5 and spring 8 to prevent electrical coupling when the power source is supplied. Spring member 8 is placed in the middle of insulation member 17 with its shape being the same as spring member 9 as shown in FIG. 4-2. Spring member 9 is inserted in a long slot 16 and is contacted with the end 72 of bent spring member 7. The long slot 15 has inserted therein a U-shaped spring member 10 at an opposite positional location when taken with respect to the rivet 13. By the outward biasing and spring force of spring 10, such is contacted with the end 52 of the bent spring member 5. The other end of the spring 10 is contiguously mounted and supported by the rivet 13 formed in the corresponding hole. In this manner, electricity is conducted from the spring member 5 to the screwshell member 3 by help of rivet 13 and additionally, one end of the U-shaped spring 10 is locationally in contact with the rivet 13 which restrains displacement of the spring member 10.

Figure 6:
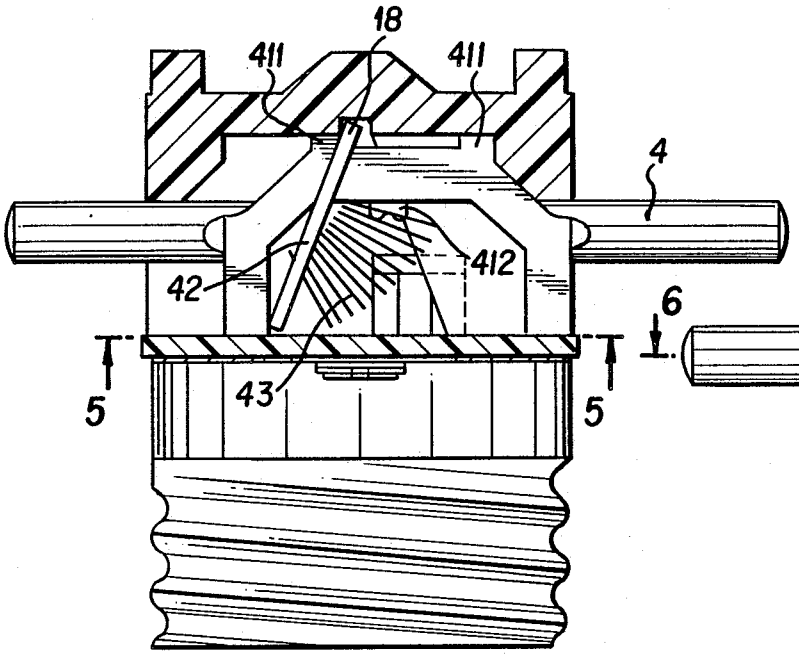
FIG. 6 is a sectional elevational view of the electrical push-pull connector showing the actuation of a C-type sliding brass member and spiral spring biasing member.

As shown in FIG. 6, there is a side view of the push-through type set 4 which presents a form which is placed in the center slot 19 of the body or housing 1. This includes a push-pull stem 41, a C-shaped sliding brass member 42, and a spiral spring member 43 which is squeezingly displaced between the nipple 412 shown in FIG. 6 and the C-type sliding brass member 42. One end of the C-type sliding brass member 42 is blocked by an opening 18. The push-through stem set 4 is reversibly pushed or pulled in a predetermined direction. The C-type sliding brass member 42 produces a marked effect of a switch by means of contact upon the springs 81 and 91 as shown in FIG. 5. When the sliding brass member 42 is displaced in opposite directions, there is an electrical contact and a non-electrical contact condition.

When electricity conducts through the electrical lead wire A which is inserted within the opening or hole 11, electricity passes to a bulb member along spring member 5 to U-shaped spring 10 and then to rivet 13 and to screwshell member 3. When another electrical lead wire B is inserted in the hole 12, electricity passes to the bulb member along through the bent spring 7 to the spring member 9 and to the C-type sliding brass member 42 by means of the push-pull stem member displacement.

The subject invention takes the advantage of the construction of the shoulders 51 and 71 shown in FIGS. 3-1 and 4-1 on the respective bent springs 5 and 7 shown in FIGS. 3 and 4, in order to match or mate with the pits and grooves to hold the bent springs 5 and 7 in a firmly held location. Additionally, the subject invention takes advantage of the preventive or insulation member 17 and the C-type spring 10, as well as the push-through type stem set 4 of the connector for switched medium base lamp holders in order to achieve improvement characteristics of economical, practical and convenient utility. It is believed that currently there is no construction of a lamp holder which provides for this combination of elements.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An electrical push-pull connector, comprising:

a housing, having a pair of slots formed through a top surface thereof for insertion of a pair of electrical leads;

an insulation disc secured to said housing;

a screwshell member secured to said housing, said screwshell and said insulation disc being rivetted to said housing, said screwshell being substantially tubular in contour having internal threads for threaded coupling to a lamp base;

displaceable actuation means for electrically actuating said connector, said displaceable actuation means including a longitudinally extending and displaceable push-pull stem member extending through said housing, said push-pull stem member having coupled thereto an electrically conductive sliding brass member displaceable within a central slot formed in said housing, and a coil spring contacting said stem member for biasing said stem member in a predetermined direction;

a pair of bent spring members locationally positioned on opposing sides of said central slot for displaceable contact with said sliding brass member;

an insulation member mounted on said insulation disc; and, a C-contoured spring positioned within a recess of said housing for contacting one of said bent spring members.

2. The electrical push-pull connector as recited in claim 1 wherein said pair of bent spring members are inserted into a respective pair of recesses within said housing, said recesses being of a wider dimension at the tip of said bent spring members in a central location of said housing, said housing including a pair of half-moon contoured recesses formed therein for insert of said electrical leads, a pair of bent springs inserted into said half moon contoured recesses, said bent springs being notched at one end for insert of said electrical leads.

3. The electrical push-pull connector as recited in claim 2 wherein said insulation member is composed of an electrically insulating composition material and inserted within said half moon contoured recess in positional location to prevent contact between adjacent spring members contacting said insulation member.

4. The electrical push-pull connector as recited in claim 3 where said bent spring member is inserted into said insulation member between a pair of insulation shoulders, said bent spring members being notched at one end for contact with said electrical lead members, one of said spring members having an opposing end for contact with said C-contoured spring locationally positioned under said insulating member.

5. The electrical push-pull connector as recited in claim 4 including an L-shaped spring inserted within said half-moon contoured recess for holding one of said electrical leads in electrical contact, said L-shaped spring being in contact with said spring member located within said recess.

6. The electrical push-pull connector as recited in claim 5 where said U-shaped spring member is located under the insulation member having an opening directed toward a rim of said housing, one end of said U-shaped spring member in contact with one of said spring members and another end of said U-shaped spring member in contact with a rivet member to prevent said U-shaped spring member from movement.

* * * * *